United States Patent [19]

Olsson

[11] Patent Number: 4,869,685

[45] Date of Patent: Sep. 26, 1989

[54] ELECTRICAL CONNECTOR HAVING TERMINALS WITH POSITIVE RETENTION MEANS AND IMPROVED MATING ZONES

[75] Inventor: Billy E. Olsson, New Cumberland, Pa.

[73] Assignee: AMP Incorporated, Harrisburg, Pa.

[21] Appl. No.: 272,618

[22] Filed: Nov. 17, 1988

[51] Int. Cl.[4] ..... H01R 4/24

[52] U.S. Cl. ..... 439/404

[58] Field of Search ..... 439/389–424

[56] References Cited

U.S. PATENT DOCUMENTS

| | | | |
|---|---|---|---|
| 3,444,506 | 5/1969 | Wedekind . | |
| 4,262,984 | 4/1981 | Takahashi | 439/405 |
| 4,367,004 | 1/1984 | Fujiwa et al. | 439/396 |
| 4,600,259 | 7/1986 | Olsson | 339/99 |
| 4,662,698 | 5/1987 | Olsson | 339/97 |
| 4,762,500 | 8/1988 | Dola et al. | 439/79 |

*Primary Examiner*—Joseph H. McGlynn
*Attorney, Agent, or Firm*—Bruce J. Wolstoncroft

[57] ABSTRACT

Electrical connector (1) comprises a housing body (52) which has a plurality of contact terminals (2) extending therein. Each terminal (2) has one contact leg (6) which extends from a shank portion (24) to a mating surface (78) of housing body (52). The use of only one contact leg (6) for each terminal (2) allows the mating zone of the connector (1) to have increased tolerances, thereby allowing for a slightly misaligned mating pin (80) to be inserted therein. Portions of inner ends (20) of the shank portions (24) are provided to cooperate with shoulders (70) of the housing body (52), thereby insuring that the terminals will have a positive stop means as the terminals are inserted into the housing body. The cooperation of inner ends (20) and shoulders (70) also insures that the terminals (2) will be prevented from movement when the connector housing is terminated to a ribbon cable (48).

17 Claims, 3 Drawing Sheets

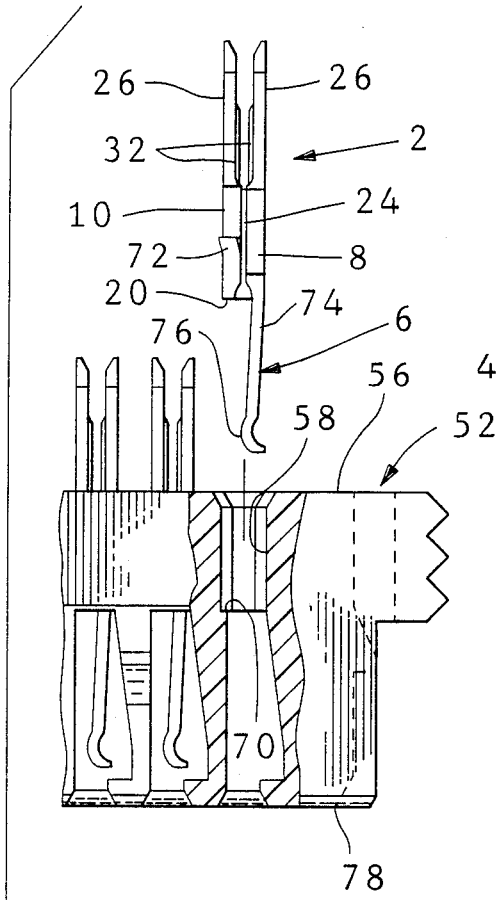
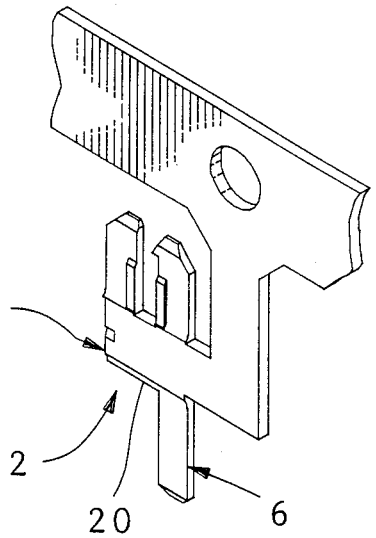
FIG. 4
FIG. 5
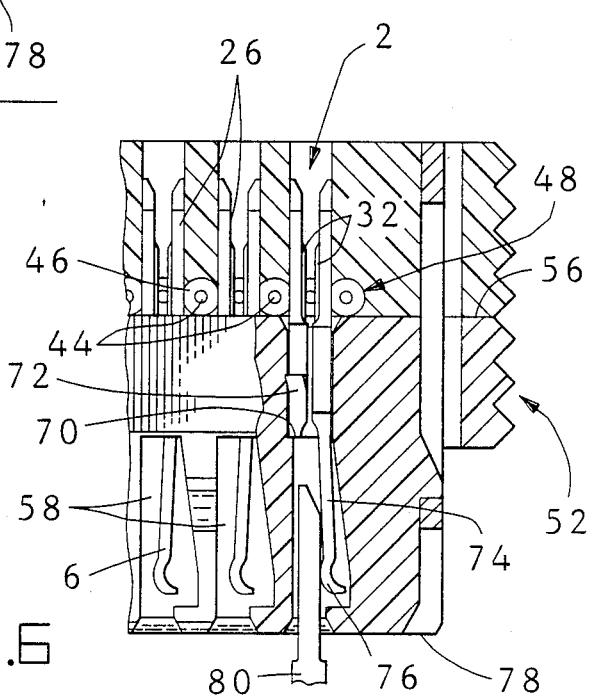
FIG. 6

ELECTRICAL CONNECTOR HAVING TERMINALS WITH POSITIVE RETENTION MEANS AND IMPROVED MATING ZONES

FIELD OF THE INVENTION

The invention relates to electrical connectors containing terminals having wire receiving slots for establishing contact with a wire inserted into the slot, particularly terminals which are intended for use with extremely fine wires. The invention is directed to the retention of the terminals in the connectors and the ease of providing the connectors in electrical engagement with mating connectors.

BACKGROUND OF THE INVENTION

U.S. Pat. No. 3,444,506 describes a multicontact electrical connector for flat cable having contact terminals therein which have wire receiving slots into which the conductors of the cable are inserted when electrical contact is made. The terminals are of flat conductive sheet metal and have a free end into which the wire receiving slot extends. The width of the slot is less than the conducting cores of the conductors so that as the conductor moves into the slot, the edges of the slot contact the conductor to form the electrical contact.

Terminals of the type described in the above-identified U.S. patent are widely used for wires having a diameter of at least 0.33 mm (0.013 inches) which is the equivalent of an AWG 28 wire, but they are not used to any significant extent for wires having a diameter less than 0.33 mm. Consequently, as the dimensions of the terminals are sufficient, retention members can be provided which cooperate with the connector to positively retain the terminals in the connector. Also, in a terminal of this size, tolerances can be easily provided, so that a mating connector does not have to be precisely aligned when the mating connector is mated to the connector (i.e. some slight alignment will be provided due to the tolerances of the terminals of the connector).

The reason for the limitation on the use of wire-in-slot or insulation displacement terminals with larger wires is that it is impractical to produce terminals having extremely narrow slots which are required for very fine wires. For example, an AWG 32 wire has a diameter of about 0.20 mm (0.008 inches) and the slot required for a wire of this size must have a width of about 0.1 mm (0.004 inches). The wire receiving slots of the terminals disclosed in U.S. Pat. No. 3,444,506 are produced in the sheet metal from which the terminals are manufactured by means of conventional punch and die techniques (a punch is provided having an opening into which the punch moves). The sheet metal is supported on the die and when the punch moves into the die, the slot is formed. As a practical matter, it is not possible to produce slots in sheet metal of a given thickness which have a width which is significantly less than the thickness of the sheet metal.

U.S. Pat. No. 4,600,259 discloses a terminal which has a wire receiving slot which is not manufactured by the standard punch and die techniques. Instead, the wire receiving slot is a folded section of sheet metal, which produces a pair of parallel platelike members which cooperate with the wires. The configuration of the terminals are more compact than previously available, and for that reason, are desirable for use with extremely fine wires.

These more compact terminals, when placed in a multicontact connector, provide an accurate means for terminating ribbon cable which has extremely close centerline spacing. However, several problems occur when these terminals are positioned in a connector housing. With such compact terminals and the close spacing that is required, the tolerances associated with the terminals becomes critical. As the compact nature of the terminals does not allow for large tolerances, a mating pin inserted into the pin receiving area of the terminal must be accurately aligned in order to avoid stubbing, etc. Also, due to the compact nature of the terminals, the frictional engagement between the terminals and the walls of the cavity is not great. Consequently, the retention of the terminals in the connector is insufficient as the able is terminated thereto. However, due to the size of the terminals, it is impractical to add material in order to add retention features. Therefore, a positive retention means, which does not increase the dimensions of the terminal, must be provided in order for the terminals to maintain their position in the connector housing.

The present invention is directed to the achievement of an improved electrical connector which has terminals provided therein which have positive retention means to insure that they are maintained in the connector housing as the cable is terminated thereto. The retention means do not increase the overall size of the terminals, thereby facilitating the close spacing requirements of the connector. The invention is further directed to providing compact terminals which are configured to provide a mating area which can accept slightly misaligned mating contacts therein.

SUMMARY OF THE INVENTION

The invention is directed to a multicontact electrical connector which comprises a housing which has a cable receiving face. A plurality of electrical terminals are provided in the housing, and extend beyond the cable receiving face. Free ends of the terminals are spaced from the cable receiving face, and have conductor receiving slots which extend inwardly therefrom. Each of the terminals has a shank portion with a folded piece of conductive sheet metal having a bight and first and second flat side-by-side parallel spaced apart plate-like members extending from the bight. The free ends of the terminals comprise one end of the shank portions, while inner ends comprise the opposed ends of the shank portions. The shank portions have first members which extend from and are provided in essentially the same plane as the first plate-like members, and second members which extend from and are provided in essentially the same plane as the second plate-like members. The first and second members extend from the plate-like members to the inner ends of the terminals.

First portions of inner ends of the shank portions of the terminals are provided to cooperate with respective shoulders of the connector housing. As the terminals are inserted into the openings of the connector housing, the first portions of the inner ends will engage the shoulders to provide a stop means. This insures that all of the terminals are properly inserted into the connector housing. After the terminals are properly positioned, the inner ends cooperate with the shoulders to prevent the movement of the terminals when the connector housing is terminated to the ribbon cable.

Contact legs extend from second portions of the inner ends of the shank portions. Each shank portion has only one contact leg extending therefrom. The contact legs have a mating section provided proximate an end thereof. The mating sections cooperate with pins of a mating connector to provide electrical engagement therebetween. The contact legs are spaced from sidewalls of the openings of the connector housing so that the mating sections of the contact legs can compensate for slight misalignment of the pins, thereby insuring that a positive electrical connection will be effected.

BRIEF DESCRIPTION OF THE DRAWINGS

FIG. 4 is an isometric view of a terminal prior to being formed and removed from the carrier strip.

FIG. 5 is a fragmentary view of the connector housing, with a portion of the housing shown in cross section to show the opening which receives the terminal therein.

FIG. 6 is a fragmentary view of the connector housing, similar to that of FIG. 5, showing the ribbon cable terminated to the connector assembly and a mating post inserted into the opening of the connector housing.

DETAILED DESCRIPTION OF THE INVENTION

Figure 2:
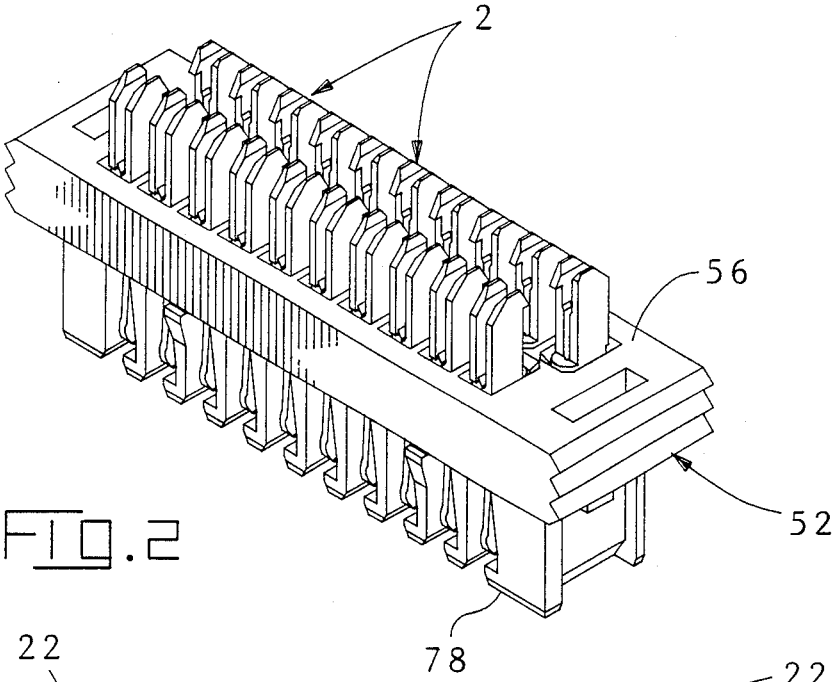
FIG. 2 is an isometric view of the connector housing with all of the terminals inserted into openings thereof.
Figure 3A:
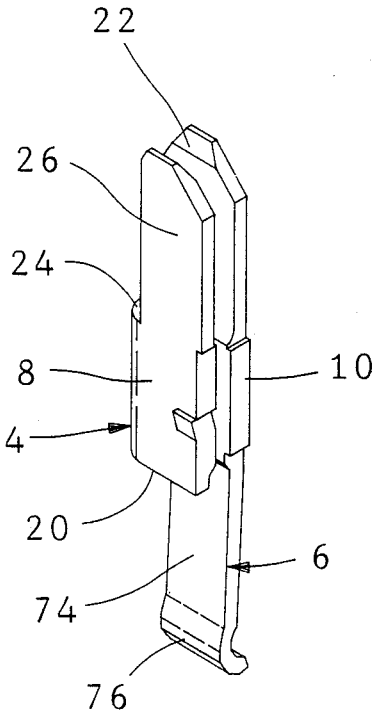
FIG. 3*a* is an isometric view of a terminal which is used in the connector assembly.
Figure 3B:
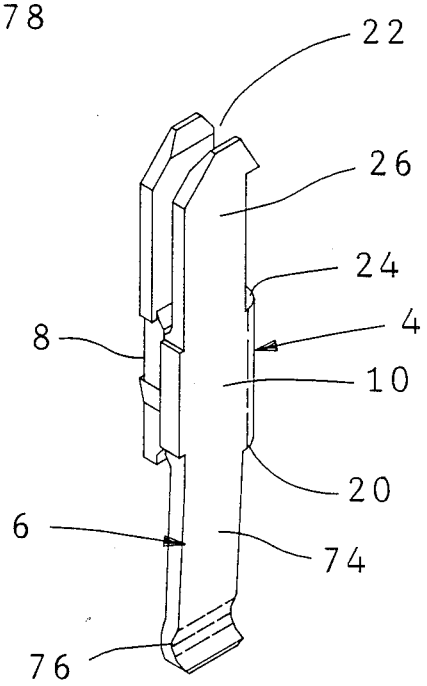
FIG. 3*b* is an isometric view of the terminal shown in FIG. 3*a*, the terminal being rotate ninety degrees from the view shown in FIG. 3*a*.

The multicontact electrical connector 1 (FIG. 2) of the present invention has terminals provided therein. As best shown in FIG. 3, each terminal comprises a shank portion 4 having a contact leg 6 extending from an inner end 20 of the shank. The shank portion 4 comprises first and second generally rectangular plate-like members 8, 10 which have oppositely facing first and second major surfaces.

As all the terminals are identical, for ease of explanation and understanding only one terminal will be described. The terminal is produced by folding a flat blank so that a first side edge of the terminal has a fold or bight provided thereon. The bight 24 has one end which is spaced from a free end 22 of the terminal, as shown in FIG. 3. The bight extends from the one end towards the inner end 20 and the portion of the shank between the bight and the free end 22 can be considered as a contact or conductor receiving section 26.

As shown in FIG. 5 and 6, the plate-like members 8, 10 have opposed internal first and second surfaces in the contact or conductor receiving section 26, these internal surfaces have opposed contact surface sections 32 which are adjacent to the bight 24. The wire receiving slot of the terminal is the space between the opposed plate-like members in the contact section 26 and a wire can therefore be aligned with this slot and moved laterally of its axis into the slot until it is between the opposed contact surface sections 32. It will be noted that the ends of these contact surfaces 32 are spaced from the free end of the terminal.

A terminal as described above which is manufactured from stock metal having a thickness of 0.30 mm is sufficiently robust to withstand the handling to which it must be subjected when it is manufactured and assembled to an electrical connector. The disclosed form of the terminal is particularly strong in that the folded bight portion 24 of the shank is composed of material which has been severely work hardened by the folding operation. It will be noted that the contact surface sections 32 are immediately adjacent to and in alignment with the bight 24. The stresses thus imposed on the terminal during insertion of the wire can thus be transmitted to the strongest part of the terminal so that it is able to withstand these forces.

Terminals, as described above, can be produced in a wide range of sizes for wires of varying diameters. However, the terminals have particular advantage for relatively fine wires. For a more detailed discussion of the terminals, refer to U.S. Pat. No. 4,600,259, which is hereby incorporated by reference.

Figure 1:
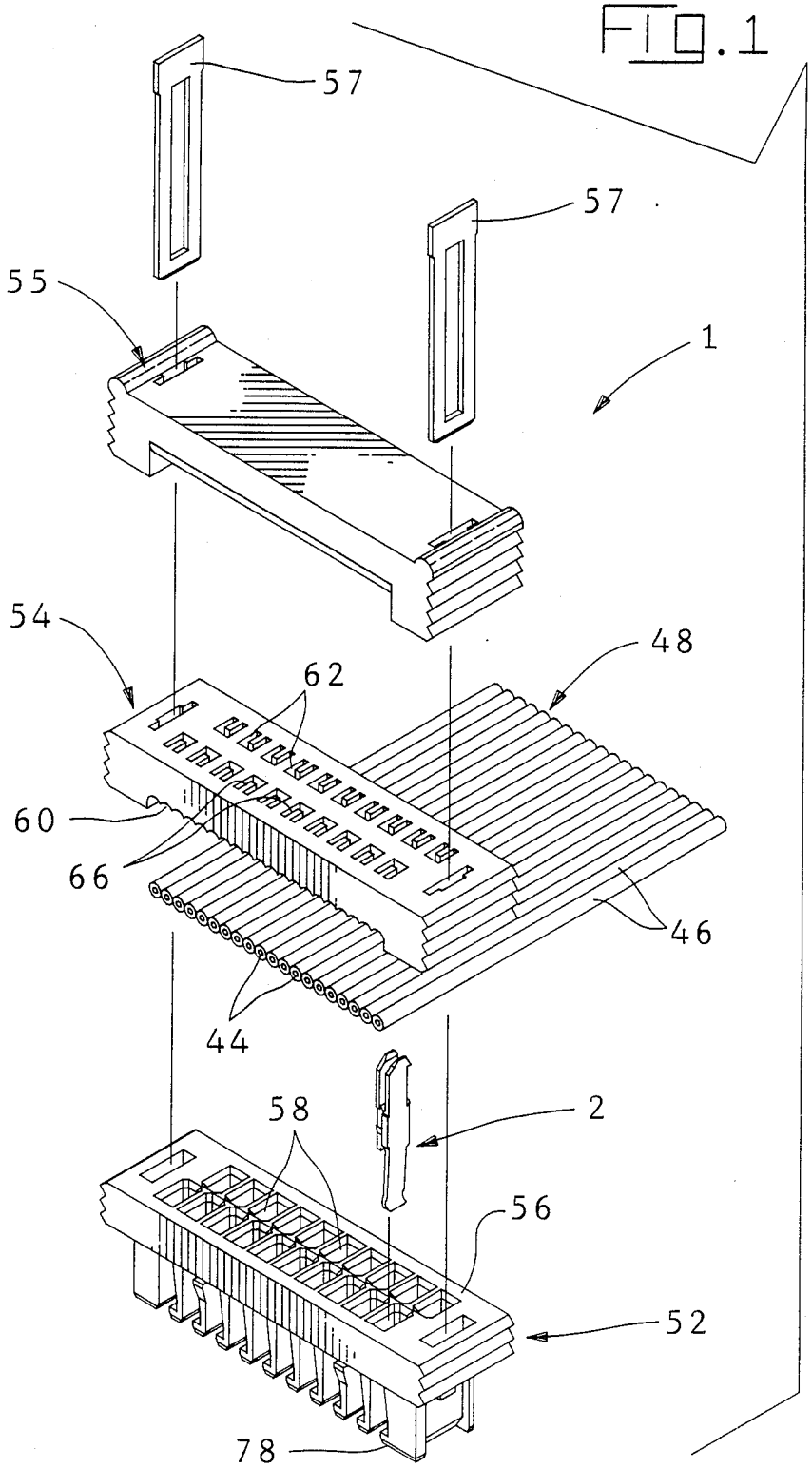
FIG. 1 is an exploded isometric view of a connector assembly of the present invention showing a ribbon cable to which the connector assembly will be terminated.

FIG. 1 shows the connector assembly 1 which is intended to be installed on a multicondcutor cable 48 having a plurality of conductors 44 in side-by-side relationship contained in insulating material 46. The connector assembly comprises a housing body 52, a cover 54 which is assembled to the housing 52 against the conductor receiving surface 56 thereof, a strain relief member 55, and retention bars 57. The housing body has a plurality of openings 58 which receive the shank portions of the terminals in a manner such that the contact sections 26 extend beyond the surface 56, as shown in FIGS. 2 and 6. Advantageously, the bight portions of the terminals are recessed slightly from the surface 56 as shown in FIG. 6.

As shown in FIG. 1, the cover 54 has a scalloped surface as shown at 60 for supporting the cable and has a plurality of U-shaped openings 62 which receive the sections 26 of the terminals. Ribs 66 in these openings are dimensioned to be received in the coined zones 40 of the terminals and functions to support the conductor immediately adjacent to the wire contacting surface sections 32 when the wires are being pushed into the wire receiving slots. Installation of the connector on the cable requires that the cable be placed on the surface 60 of the cover 54 and the connector body or housing 52 be aligned with the cable and assembled to the cover. This operation is performed in a fixture, such as that described in U.S. Pat. No. 4,741,099, the teaching of which is hereby incorporated by reference. During such assembly, the conductors will move into the wire receiving slots and will be received between the surface portions 32 which will establish electrical contact. The cover may be dimensioned so that the openings 62 will provide additional support the free ends of the plate-like members in the contact section 26 against outward flexure. In other words, the contact sections 26 may be dimensioned to have an interference fit in the openings 62 so that the contact surfaces will be held against the wire by the sidewalls of the housing cover.

Terminals and connectors in accordance with the inventions can be of any desired dimensions, however, the principles of the invention offer particular advantages where the conductors are contained in a flat cable 48 and the distance between adjacent conductors 44 is extremely small. Cables 48 are now being used which have a center-to-center spacing of 0.025 inches (0.64 mm). Connectors of this type must also be capable of being installed on the cable 48 without stripping the insulation 48 from the cable. It follows that the terminals must be sufficiently strong to withstand the forces imposed when they are pushed through the cable insulation and when the conductors enter the terminals. Terminals in accordance with the present invention are extremely robust as noted above by virtue of the fact that the bight 24 extends along one of the side edges of the shank portion and the contact surfaces 32 are immediately adjacent to the bight portion in the preferred embodiment.

As the connector housing 52 is installed on cable 48, the force required to insure proper termination is significant, particularly in light of the small size of the terminals. It is therefore important that enough support be provided by housing 52 to the terminals in order to maintain their integrity and accurate position relative to the housing. However, this support must be provided in such a way so as to not increase the size of the terminal, as the minimal space requirements must be satisfied. As has been discussed, it is essential that the terminals be maintained in position relative to housing 52, particularly because of the accuracy required due to the small size of the connector assembly and ribbon cable. In many cases, the need for the accurate positioning of the terminals in such a connector assembly is magnified due to the small tolerance ranges associated therewith. Consequently, even slight misalignment or movement of the terminals will cause an ineffective electrical connection between the terminal and respective conductors. In order to maintain the terminals in a position in which proper termination can occur, it is important that the terminals are not movable (after they are properly inserted into the housing) in a direction which is parallel to the longitudinal axis of openings 58. This insures that the contact surface sections 32 of the terminals 2 will be maintained above the conductor receiving surface 56 of the housing 52 when the housing is terminated to the cable, thereby insuring that the contact surface sections will cooperate with the conductors of the cable to provide a positive electrical connection therebetween. However, as the termination of the cable generates a significant force on the terminals, it is essential that a substantial positive retention means be provided to retain the terminals in position.

In order to provide the retention required, the retention means must be provided on both the terminals and the connector housing. As is best shown in FIG. 6, when each terminal 2 is fully inserted into opening 58, inner end 20 of shank 4 cooperates with shoulder 70 of housing 52. This cooperation of inner ends 20 and shoulders 70 prevents the downward movement of the terminals, as viewed in FIG. 6. In other words, as connector housing 52 is terminated to cable 48, a downward force will be applied to the terminals 2, as viewed in FIG. 6. This downward force will attempt to move the terminals further into openings 58 of housing 52, thereby causing the contact surface sections 32 of terminals 2 to not cooperate with the conductors of cable 48, resulting in an ineffective electrical connections. However, this downward motion is prevented because of the cooperation of ends 20 and shoulder 70. As the force is applied to the terminals, ends 20 engage shoulders 70 to prevent the movement of the terminals. In the embodiment shown, shoulders 70 and ends 20 are positioned in a plane which is essentially perpendicular to the plane in which the termination force is applied to the terminals. However other configurations are possible.

It should be noted that ends 20 and shoulders 70 are configured to withstand a large force applied thereto. In other words, the retention means of ends 20 and shoulders 70 is able to withstand the maximum termination force without failure. Consequently, as the terminals are positively retained in position, a much more reliable electrical connection is effected.

The cooperation of ends 20 and shoulders 70 also act as a positive positioning means. As the terminals are inserted into openings 58, the insertion will continue until inner ends 20 engage shoulders 70. Upon the engagement of inner ends 20 with shoulders 70 the terminals 2 are properly positioned in the opening, and the insertion of the terminals is complete. Consequently, the accurate positioning of the terminals in the housing is insured, as a positive stop means is provided.

Once terminals 2 are properly positioned in openings 58, and prior to the cover being assembled to the housing body 52, the terminals are prevented from being removed from the openings because of the cooperation of lances 72 of terminals 2 and sidewalls of openings 58. The configuration of lances 72 allows for the insertion of terminals 2 into openings 58 of housing 52. However, if an attempt is made to remove the terminals from the openings, the ends of the lances, which are relatively sharp, will displace a portion of the dielectric material which defines the sidewall. Therefore, the cooperation of lances 72 and sidewalls of opening 58 prevents the removal of the terminals from the openings. Consequently, when the terminals are fully inserted into the openings, the cooperation of ends 20 and lances 72 of the terminals with the shoulders 70 and sidewalls of the openings 58 prevents the terminals from being moved in a direction which is essentially parallel to the longitudinal axis of the openings, so that the terminals are maintained in an accurate position with respect to the housing of the connector assembly.

It should be noted that, for each terminal 2, only one portion of inner end 20 cooperates with shoulder 70. Extending from another portion of inner end 20 is a contact leg 6. This contact leg extends in a direction away from conductor receiving surface 56. Contact leg 6 has a resilient arm 74 and a mating section 76, as best shown in FIGS. 5 and 6. The mating section is provided proximate a mating surface 78 of housing 52 of connector assembly 1.

Having only one contact leg provided on each terminal is beneficial for several reasons. First, the use of only one contact leg allows a portion of the inner ends to be used as a retention means, as described above. A second benefit of having only one contact leg on each terminal relates to the plating of the mating section 76. With only one leg provided, the plating process is simplified, and the cost associated therewith is greatly reduced. A third and perhaps more critical reason for providing one contact leg is to provide increased tolerances in the mating zone of the connector assembly 1. Due to the small size and close spacing of the terminals it is important to provide a mating area in which the tolerance limits do not require the perfect alignment of mating posts 80 with openings 58, as this exact alignment is practically impossible to obtain in real world situations. Therefore, it is essential that the configuration of the mating sections 76 of the terminals be configured to accept slightly misaligned posts 80, i.e. that the mating section have enough tolerance associated therewith the make a positive electrical connection with a mating post which is slightly misaligned. In order to accomplish this, each contact leg undergoes reverse forming, so that the contact leg has the advantage of additional spring back. This process produces a contact leg which provides for maximum deflection in the elastic range of the material, thereby preventing premature yielding. Consequently, the contact leg will not easily take a permanent set. It should be noted that the high density of the connector does not allow for properly working dual contact legs in each opening.

Providing terminals 2 which have only one contact leg 6 allows for the insertion of slightly misaligned posts, and insures that electrical connection between the posts and the mating sections will occur. By using a single leg terminal, the tip of post 80 only requires coining from one side, as shown in FIG. 6. This large coined area provided on the tip of the post allows for a slightly misaligned post to be guided into opening 58, thereby allowing a positive electrical connection to be effected between terminals 2 and respective posts 80, without stubbing the posts on the terminals.

The present invention is directed to providing an electrical connector for terminating flat ribbon cable having closely spaced conductors thereto. The electrical connector has terminals provided therein which are relatively small and which are closely spaced to each other. Consequently, the terminals cooperate with the connector housing is such a manner as to provide a positive retention means which maintains the terminals in position relative to the housing, while not increasing the overall dimensions of the terminals. The configuration of the terminals also provides a mating area which has a relatively large tolerance, in comparison with the size of the terminal. This large tolerance insures that a positive electrical connection will be effected and maintained between the terminals and slightly misaligned mating posts.

Changes in construction will occur to those skilled in the art and various apparently different modification and embodiments may be made without departing from the scope of the invention. The matter set forth in the foregoing description and accompanying drawings is offered by way of illustration only.

I claim:

1. A multicontact electrical connector comprising:

a housing having a cable receiving face;

a plurality of electrical terminals in the housing, the terminals extend beyond the cable receiving face and have free ends which are spaced from the cable receiving face, the terminals have conductor receiving slots which extend inwardly from the free ends, each of the terminals has a shank portion having a folded piece of conductive sheet metal having a bight and first and second flat side-by-side parallal spaced apart plate-like members extending from the bight, the free ends of the terminals being one end of the shank portions, the shank portions having inner ends which are within the housing, the shank portions having first members which extend from and are provided in essentially the same plane as the first plate-like members, and second members which extend from and are provided in essentially the same plane as the second plate-like members, the first and second members extend from the plate-like members to the inner ends of the terminals;

first portions of the inner ends cooperate with shoulders of the housing, to accurately position and maintain the terminals in the housing as conductors are terminated in the conductor receiving slots;

second portions of the inner ends are integrally attached to contact legs, the contact legs extend from the inner ends of the shanks in a direction away from the cable receiving face, so that mating sections of the contact legs are provided proximate a mating surface of the housing;

whereby as pins of a mating connector are inserted through the mating surface of the connector, the contact legs of the terminals insure that a positive electrical connection is effected between the terminals and the mating pins.

2. A multicontact electrical connector as recited in claim 1 wherein the shoulders of the housing are provided on sidewalls of terminal receiving openings which are provided in the housing, the shoulders are positioned proximate the cable receiving face of the housing.

3. A multicontact electrical connector as recited in claim 1 wherein each terminal has one contact leg extending from the inner end of the shank, thereby providing the contact leg with the tolerance required to accept slightly misaligned mating pins therein.

4. A multicontact electrical connector as recited in claim 1 wherein lances are provided on the terminals, the lances cooperate with sidewalls of terminal receiving openings of the housing to insure that the terminals will not move toward the cable receiving face.

5. A multicontact electrical connector as recited in claim 4 wherein the lances are provided proximate the inner ends of the shank portions, such that when the terminals are inserted into the openings of the housing, the lances and the first portions of the inner ends cooperate with the sidewalls and the shoulders to prevent the movement of the terminals in a direction which is essentially parallel to the longitudinal axis of the terminals.

6. A multicontact electrical connector which terminates to a multiconductor ribbon cable, the electrical connector comprising:

a connector housing having a cable receiving face and a mating face, terminal receiving openings extend from the cable receiving face to the mating face;

a plurality of terminals provided in the terminal receiving openings, the terminals have ribbon cable engagement sections which extend beyond the cable receiving face of the connector housing, and mating portions which are provided poximate the mating face of the connector housing, shank portions are provided on each terminal, the shank portions are positioned in the openings of the connector housing;

first portions of inner ends of the shank portions of the terminals are provided to cooperate with respective shoulders of the connector housing, such that as the terminals are inserted into the openings of the connector housing, the first portions of the inner ends will engage the shoulders to provide a stop means, thereby insuring that all of the terminals are properly inserted into the connector housing, and after the terminals are properly positioned, the inner ends cooperate with the shoulders to prevent the movement of the terminals when the connector housing is terminated to the ribbon cable.

7. A multicontact electrical connector as recited in claim 6 wherein contact legs extend from second portions of the inner ends of the shank portions, each shank portion having only one contact leg extending therefrom, the contact legs have a mating section provided proximate an end thereof, the mating sections cooperate with pins of a mating connector to provide electrical engagement therebetween, the contact legs being spaced from sidewalls of the openings of the connector housing so that the mating sections of the contact legs can compensate for slight misalignment of the pins, thereby insuring that a positive electrical connection will be effected.

8. A multicontact electrical connector as recited in claim 6 wherein the shoulders of the housing are provided on sidewalls of the terminal receiving opening, the shoulders are positioned proximate the cable receiving face of the housing.

9. A multicontact electrical connector as recited in claim 7 wherein each terminal has one contact leg extending from the inner end of the shank, thereby providing the contact leg with the tolerance required to accept slightly misaligned mating pins therein.

10. A multicontact electrical connector as recited in claim 9 wherein lances are provided on the terminals, the lances cooperate with sidewalls of the terminal receiving openings of the housing to insure that the terminals will not move toward the cable receiving face.

11. A multicontact electrical connector as recited in claim 10 wherein the lances are provided proximate the inner ends of the shank portions, such that when the terminals are inserted into the openings of the housing, the lances and the first portions of the inner ends cooperate with the sidewalls and the shoulders to prevent the movement of the terminals in a direction which is essentially parallel to the longitudinal axis of the terminals.

12. A multicontact electrical connector which terminates to a multiconductor ribbon cable, the electrical connector comprising:

a connector housing having a cable receiving face and a mating face, terminal receiving openings extend from the cable receiving face to the mating face;

a plurality of terminals provided in the terminal receiving openings, the terminals have ribbon cable engagement sections which extend beyond the cable receiving face of the connector housing, and mating portions which are provided poximate the mating face of the connector housing, shank portions are provided on each terminal, the shank portions are positioned in the openings of the connector housing;

contact legs extending from second portions of inner ends of the shank portions, each shank portion having only one contact leg extending therefrom, the contact legs have a mating section provided proximate an end thereof, the mating sections cooperate with pins of a mating connector to provide electrical engagement therebetween, the contact legs being spaced from sidewalls of the openings of the connector housing so that the mating sections of the contact legs can compensate for slight misalignment of the pins, thereby insuring that a positive electrical connection will be effected.

13. A multicontact electrical connector as recited in claim 12 wherein first portions of inner ends of the shank portions of the terminals are provided to cooperate with respective shoulders of the connector housing, such that as the terminals are inserted into the openings of the connector housing, the first portions of the inner ends will engage the shoulders to provide a stop means, thereby insuring that all of the terminals are properly inserted into the connector housing, and after the terminals are properly positioned, the inner ends cooperate with the shoulders to prevent the movement of the terminals when the connector housing is terminated to the ribbon cable.

14. A multicontact electrical connector as recited in claim 13 wherein the shoulders of the housing are provided on sidewalls of the terminal receiving openings, the shoulders are positioned proximate the cable receiving face of the housing.

15. A multicontact electrical connector as recited in claim 12 wherein each terminal has one contact leg extending from the inner end of the shank, thereby providing the contact leg with the tolerance required to accept slightly misaligned mating pins therein.

16. A multicontact electrical connector as recited in claim 12 wherein lances are provided on the terminals, the lances cooperate with sidewalls of the terminal receiving openings of the housing to insure that the terminals will not move toward the cable receiving face.

17. A multicontact electrical connector as recited in claim 16 wherein the lances are provided proximate the inner ends of the shank portions, such that when the terminals are inserted into the openings of the housing, the lances and first portions of the inner ends cooperate with the sidewalls and shoulders of the housing to prevent the movement of the terminals in a direction which is essentially parallel to the longitudinal axis of the terminals.

* * * * *